US006375091B1

(12) United States Patent
Cha

(10) Patent No.: US 6,375,091 B1
(45) Date of Patent: Apr. 23, 2002

(54) STRAW

(76) Inventor: Arnold Cha, 113366 E. South St., Cerritos, CA (US) 90703

( * ) Notice: Subject to any disclaimer, the term of this patent is extended or adjusted under 35 U.S.C. 154(b) by 0 days.

(21) Appl. No.: 09/760,537

(22) Filed: Jan. 17, 2001

(51) Int. Cl.[7] ..... A61J 15/00
(52) U.S. Cl. ..... 239/33
(58) Field of Search ..... 239/33

(56) References Cited

U.S. PATENT DOCUMENTS 5,601,207 A * 2/1997 Paczonay ..... 215/11.4

* cited by examiner

*Primary Examiner*—Lesley D. Morris
(74) *Attorney, Agent, or Firm*—John K. Park; Park & Sutton LLP

(57) ABSTRACT

The straw includes an output end that is inventively constructed to provide added benefits for the user. An output shield is attached to the output opening. The output shield has an upper portion, a first projection and an interior angle. The upper portion of the output shield extends outward from the output end. The angular placement of the first projection allows the first projection to project in front of the output opening. When fluid exits the output opening and strikes the output shield and the first projection, the fluid is directed downward towards the tongue rather than striking the roof of the mouth.

11 Claims, 4 Drawing Sheets

STRAW

BACKGROUND

Conventional straws typically cause a hot fluid or liquid that is drawn through the straw to strike the roof of the mouth. When the liquid first strikes the roof of the mouth and mixes with air the taste of the liquid can be noticeably altered. The original taste of the liquid is thus changed prior to striking the taste buds on the tongue. The taste buds are predominately located on the tongue, thus of all the parts of the mouth, the tongue is the most capable of fully appreciating the subtle and distinctive tastes of a liquid being drank.

Additionally, another undesirable effect occurs when conventional straws cause the hot liquid to strike the roof of the mouth. The roof of the mouth is the most perceptive part of the mouth with regard to heat sensitivity. The hot liquid drawn through the conventional straw is extremely hot when it immediately contacts the roof of the mouth, leading to discomfort or even immediate burning of the skin tissue.

Therefore, there is a need for a straw that will allow the liquid to contact the taste buds of the tongue first, so that the taste of the liquid is fully enjoyed.

Additionally there is a second desire that the straw direct the hot liquid away from the roof of the mouth, which has the greatest heat sensitivity.

SUMMARY

The present invention of a new and useful straw fulfills the aforementioned needs, by achieving the objectives of first allowing the liquid to contact the taste buds of the tongue immediately, and secondly the present invention directs the hot liquid away from the roof of the mouth, which avoids discomfort or pain caused by the heat sensitivity of the roof of the mouth.

The new straw can substantially take the shape and form of a typical straw through out much of the straw's length. The shape can be a hollow cylindrical body having a diameter, an input end with an input opening, an output end with an output opening, an upper surface and a lower surface. Commonly used straws take this symmetrical form with the input opening and the output opening having the same shape. Alternately, the straw can be other than a cylindrical shape, such as, a square, octagonal or oval shape.

In the present invention the output end is inventively constructed to provide added benefits for the user. An output shield is attached to the output opening. The upper surface is extended to form the output shield. The output shield has an upper portion, a first projection, and an interior angle.

In a preferred embodiment, the upper portion of the output shield extends outward from the output end. The upper portion is substantially parallel to the surface of the hollow cylindrical body. The first projection attaches to the upper portion at an angle, thus forming an interior angle between the upper portion and the first projection. The angular placement of the first projection allows the first projection to project in front of the output opening. The straw is typically positioned in the mouth with the upper portion of the output shield near the roof of the mouth and the lower surface closer to the tongue. Fluid exits the output opening striking the output shield and the first projection, which direct the fluid downward toward the tongue.

The output end can have a lower edge, with the lower edge having a curvature, which indents the lower surface in the direction of the input end. The curvature thus reduces the length of the lower surface in relation to the upper surface.

The curvature can conform to the shape of a person'slip. Thus, when the output end and output shield are placed firmly against the person's lip or tongue, the output opening is sealed and the flow of the fluid halted. In this manner the initiating of the fluid flow and stopping of the fluid flow can be controlled. Either the tongue or the lower lip can be used to control the flow. Both are supple enough to conform to the shape of the output opening, particularly when the lower edge has a curvature that conforms to the shape of a person's lip. Alternately the lower edge of the output opening can be straight with no indentation curvature, so that the length of the lower surface is equal to that of the upper surface, when you exclude the output shield.

A second projection can be attached to the first projection. An exterior angle is formed by the first projection and the second projection, the exterior angle being between 45 degrees and 170 degrees. A preferred embodiment has an exterior angle of about 90 degrees.

The second projection can be positioned to touch the roof of the mouth, providing stimulation to the sensitive skin area. Alternately the second projection can be positioned downward so that any fluid that splashes past the first projection toward the back of the mouth will be directed by the second projection toward the tongue and taste buds.

The first projection has a first length and the second projection has a second length. In one embodiment the first projection has a length of about between 5 and 6 milimeters and the second projection has a length of about between 5 and 6 milimeters. The length of the projections can vary to create different paths and directions of fluid flow. A longer first projection tends to substantially deflect the fluid or liquid towards the tongue, so that minimal amount of the fluid actually deflected from the second projection. When the first projection is very short then a partial deflection of the liquid is performed by the first projection and the liquid strikes the second projection with a substantial force. The second projection when properly angled can then fully deflect the remainder of the liquid towards the tongue.

The first projection or the second projection can take various shapes including substantially; a square, rectangle, triangle or a half circle. When the second projection is included in the design embodiment then the first projection should be a rectangle, square or other shape that provides a sufficient end edge, to which, the second projection can be attached.

The diameter of the hollow cylindrical body can vary. A preferred embodiment has a diameter of about 7 milimeter. In one embodiment, the first projection and the second projection can have a length about equal to the diameter of the straw. This relationship provides a form that sufficiently deflect the fluid towards the tongue.

The upper portion can have edges that are straight or the edges may have an angular curvature. The upper portion may be deminimis, such that, first projection begins about immediately from the output end and output opening.

In a preferred embodiment the straw is formed from a plastic material. The straw can be clear, a single color, multi-colored or other color variations and designs.

One version of the straw includes a hollow body having an input end, an input opening, an output end, an output opening, a lower edge, an upper surface, and a lower surface. An output shield is formed by the upper surface extending beyond the output end and beyond the lower surface. The output shield is attached to the output opening. The output shield has an upper portion, a first projection and an interior angle formed by the upper portion and the first projection.

The interior angle is less than 160 degrees. In a preferred version the interior angle is about 60 degrees. A fluid drawn through the straw will strike the output shield, and the fluid is directed toward a tongue of a mouth.

The straw can be formed so the hollow body is cylindrical. The lower edge can include a curvature that conforms to the shape of a person's lip. When the output end and the output shield are placed firmly against the person's lip or tongue, the output opening is sealed by the lip or tongue to stop the flow of the fluid.

A second projection can be attached to the first projection having an exterior angle that is between 45 degrees and 170 degrees. In a preferred version the exterior angle is about 90 degrees. The distance between the first projection and the output end can be between about 7 and 15 milimeters. The distance between the upper portion and the second projection can be between about 7 and 15 milimeters. The invention is illustrated with additional detail in the appended drawings and description.

DETAILED DESCRIPTION OF THE DRAWINGS

Figure 1:
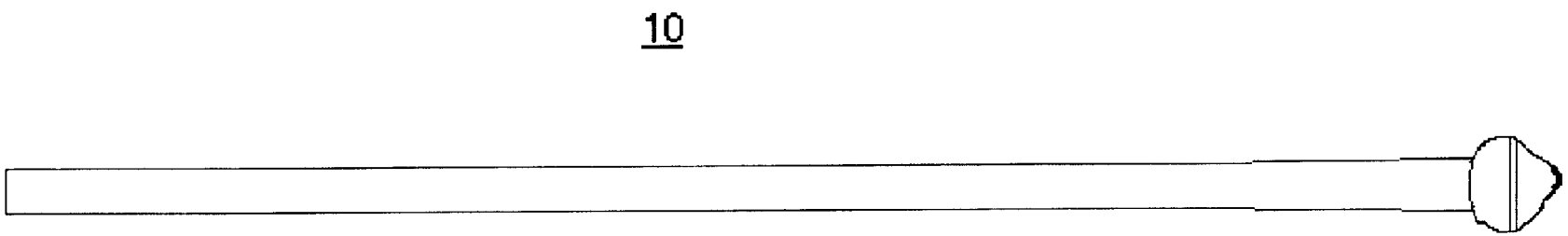
FIG. 1 shows a top view of the straw.
Figure 2:
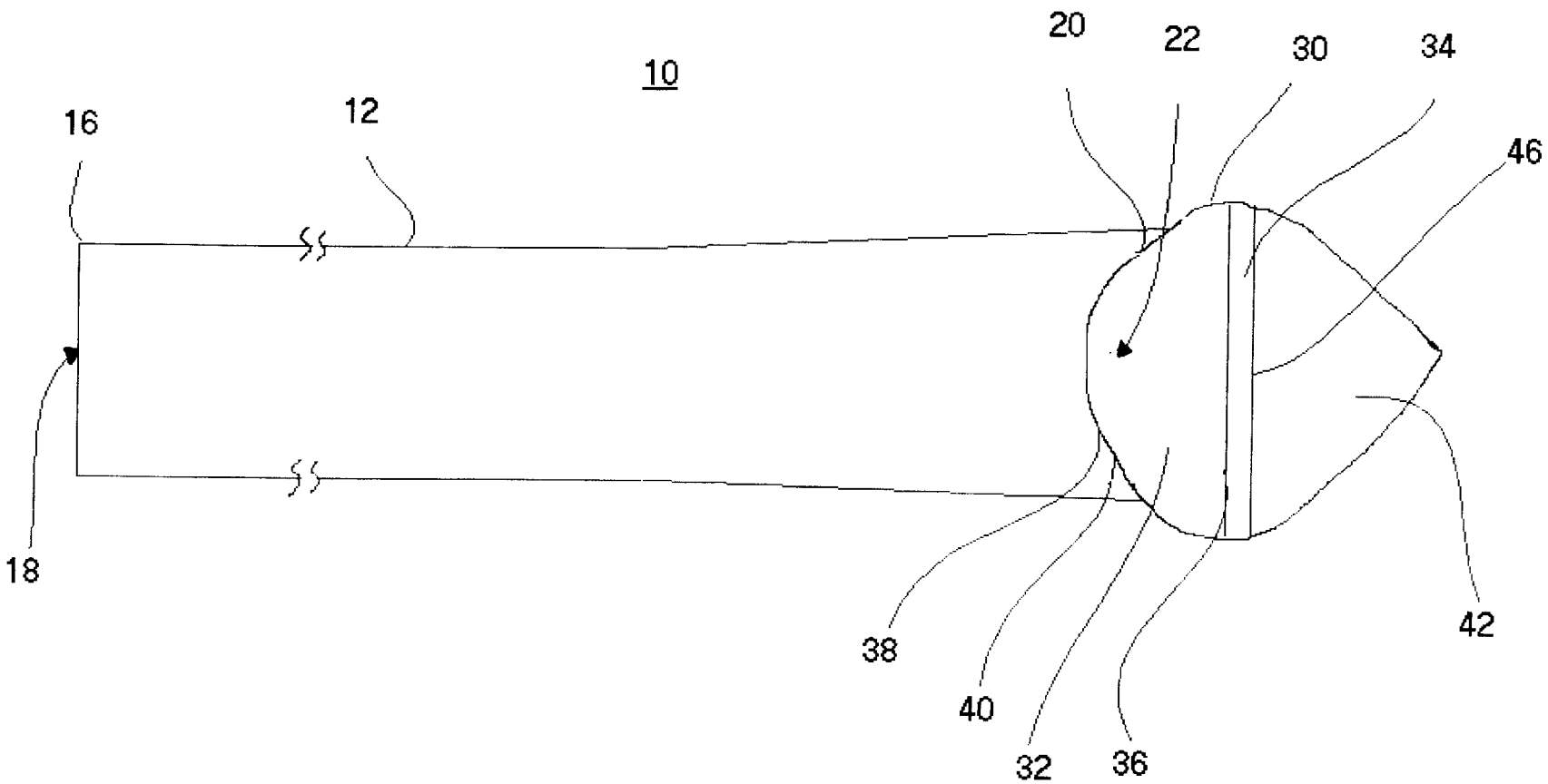
FIG. 2 shows a bottom view of the straw, zoomed in on the output end and enlarged for greater detail.
Figure 3:
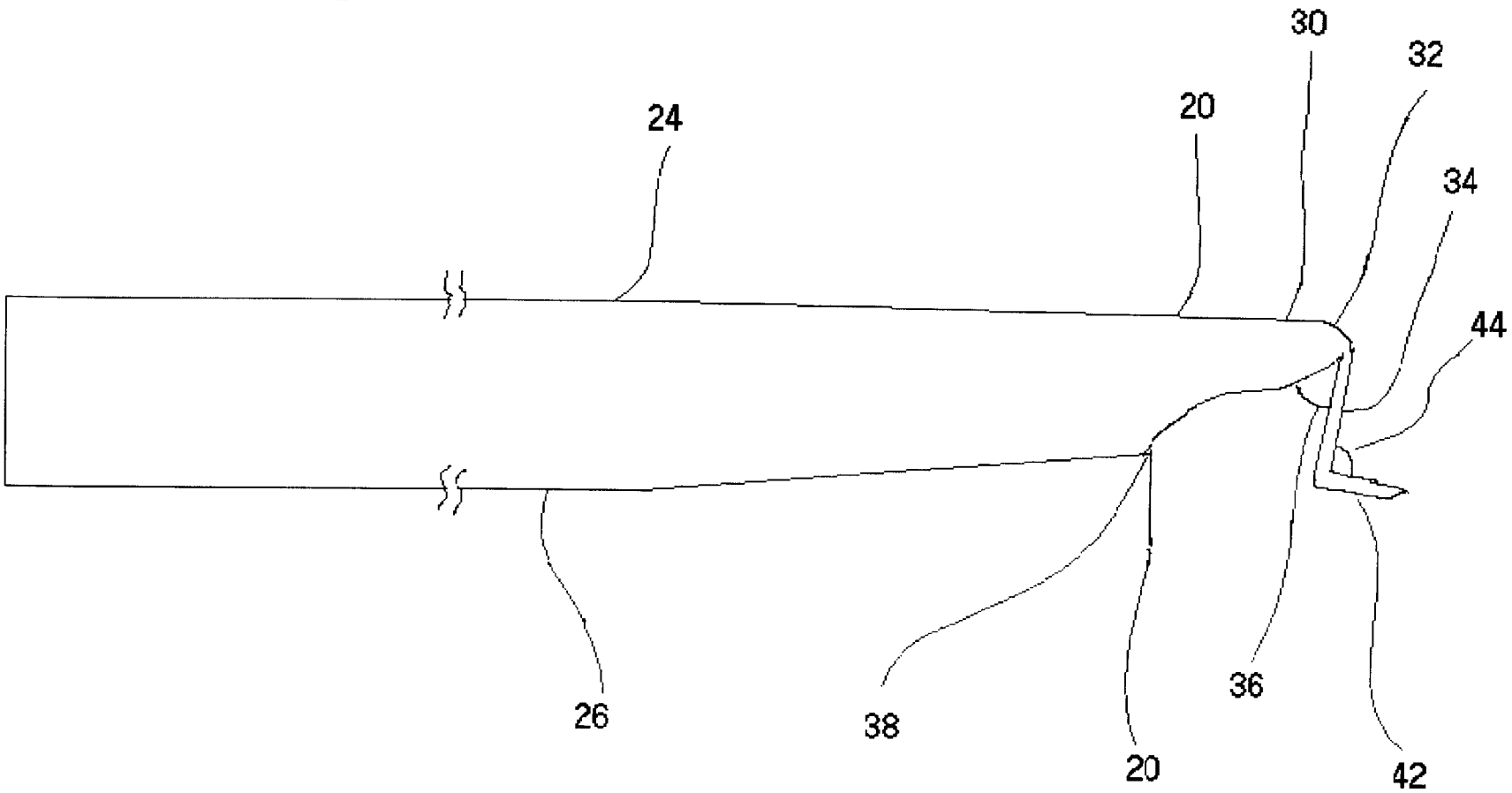
FIG. 3 shows a side view of the straw.
Figure 4:
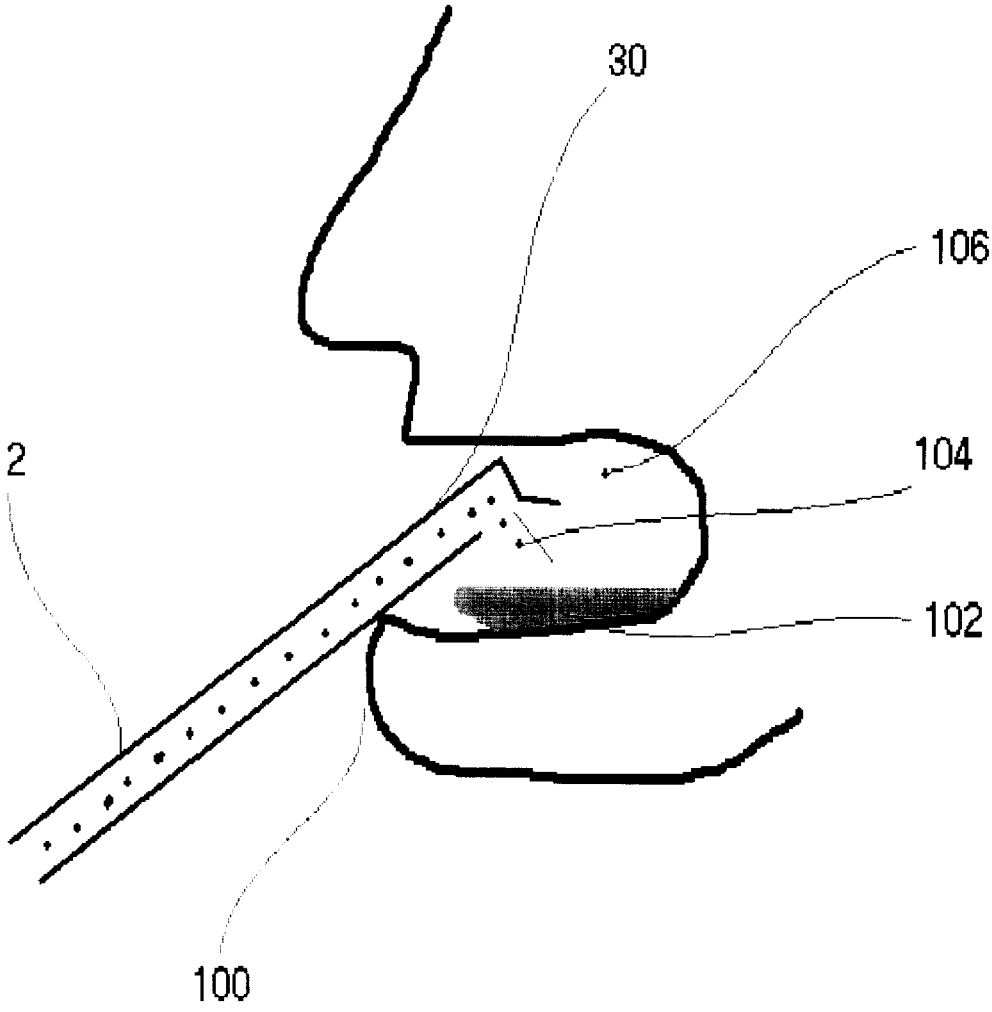
FIG. 4 shows a side view of the straw inserted into a mouth.

FIG. 1 shows the present invention of a straw 10, which is detailed in FIG. 2. Referring to FIGS. 1, 2 and 3. A straw 10 has a hollow body 12 having an input end 16, an input opening 18, an output end 20, an output opening 22, an upper surface 24, and a lower surface 26. The straw 10 can be cylindrical with a diameter or can take other shapes, such as a square. FIG. 2 depicts a substantially hollow body 12 tapered and flattened with increased width near the output end 20. FIG. 3 depicts the hollow body 12 with decreased height created by the flattening.

An output shield 30 is attached to the output end 20, wherein the upper surface 24 extends beyond the output end 20 and beyond the lower surface 26 to form the output shield 30. The output shield 30 has an upper portion 32, a first projection 34 and an interior angle 36. The interior angle 36 is formed between the upper portion 32 and the first projection 34. The interior angle 36 is less than 160 degrees. When a fluid 104 is drawn through the straw 10, the fluid 104 strikes the output shield 30, thereby directing the fluid 104 towards the tongue 102 of a mouth 106.

The output end 20 can have a lower edge 38, with the lower edge 38 having a curvature 40. The curvature 40 can conform to the shape of a person's lip 100. Thus, when the output end 20 and output shield 30 are placed firmly against the person's lip 100 or tongue 102, the output opening 22 is sealed and the flow of the fluid 104 halted. In one embodiment, the straw 10 can be formed so that the interior angle 36 is about 90 degrees.

A second projection 42 can be attached to the first projection 34. An exterior angle 44 is formed by the first projection 34 and the second projection 42, the exterior angle 44 being between 45 degrees and 170 degrees. A preferred embodiment has an exterior angle 44 of about 90 degrees.

The distance between the first projection 34 and the output end 20 can be between about 7 and 10 milimeters. The distance between the upper portion 32 and the second projection 42 can be between about 7 and 10 milimeters The first projection 34 is shown with substantially a rectangular shape and the second projection 42 is shown in substantially a triangular shape. The rectangular shape of the first projection 34 has a long end edge 46, which allows the triangular second projection 42 to be easily attached.

The straw 10 is shown tapering and flattening as it approaches the output end 20, while the input end 16 is substantially circular. The flattening causes the portion of the straw 10 near the output end 20 to be wider and less in height. FIG. 2 depicts the increased width of the straw 10 near the output end 20. FIG. 3 depicts the decreased height created by the flattening. The decreased height in the straw 10 channels the fluid 104 more directly toward the output shield 30, thus allowing the output shield 30 to effectively deflect the fluid 104 toward the tongue 102. Additionally, the fluid stream is wider as the fluid 10 deflects from the output shield 30, which causes the fluid 10 to disperse to a greater area of the tongue 102. The fluid 10 then contacts more of the taste buds upon the tongue 102, which enhances the taste perception.

Although the present invention has been described in considerable detail with regard to the preferred versions thereof, other versions are possible. Therefore, the appended claims should not be limited to the descriptions of the preferred versions contained herein.

What is claimed is:

1. A straw comprising:

a) a hollow body having an input end, an input opening, an output end, an output opening, a lower edge, an upper surface and a lower surface; and b) an output shield formed by the upper surface extending beyond the output end and beyond the lower surface, the output shield has an upper portion, a first projection and an interior angle formed by the upper portion and the first projection, the interior angle is less than 160 degrees, and wherein the output shield is attached to the output opening; whereby a fluid drawn through the straw will strike the output shield, and the fluid is directed toward a tongue of a mouth.

2. The straw of claim 1 wherein the hollow body is cylindrical.

3. The straw of claim 2 wherein the lower edge has a curvature that conforms to the shape of a person's lip, such that when the output end and the output shield are placed firmly against the person's lip or tongue, the output opening is sealed by the lip or tongue to stop the flow of the fluid.

4. The straw of claim 1 wherein the interior angle is about 60 degrees.

5. A straw comprising:

a) a hollow body having an input end, an input opening, an output end, an output opening, a lower edge, an upper surface, and a lower surface;

b) an output shield formed by the upper surface extending beyond the output end and beyond the lower surface, the output shield has an upper portion, a first projection and an interior angle formed by the upper portion and the first projection, the interior angle is less than 160 degrees, and wherein the output shield is attached to the output opening; whereby a fluid drawn through the straw will strike the output shield, and the fluid is directed toward a tongue of a mouth; and c) a second projection attached to the first projection having an exterior angle that is between 45 degrees and 170 degrees.

6. The straw of claim 5 wherein the exterior angle is about 90 degrees.

7. The straw of claim 6 wherein the distance between the first projection and the output end is between about 7 and 15 milimeters.

8. The straw of claim 7 wherein the distance between the upper portion and the second projection is between about 7 and 15 milimeters.

9. A straw comprising:

a) a hollow body having an input end, an input opening, an output end, an output opening, a lower edge, an upper surface and a lower surface, wherein the hollow body tapers to become wider in width near the output end; and b) an output shield formed by the upper surface extending beyond the output end and beyond the lower surface, the output shield has an upper portion, a first projection and an interior angle formed by the upper portion and the first projection, the interior angle is less than 160 degrees, and wherein the output shield is attached to the output opening; whereby a fluid drawn through the straw will strike the output shield, and the fluid is directed toward a tongue of a mouth.

10. The straw of claim 9 further comprising a second projection attached to the first projection having an exterior angle that is between 45 degrees and 170 degrees.

11. The straw of claim 10 wherein the hollow body tapers to become less in height near the output end.

* * * * *